US006557515B2

(12) United States Patent
Furuya et al.

(10) Patent No.: US 6,557,515 B2
(45) Date of Patent: May 6, 2003

(54) STRUCTURE FOR LUBRICATING VALVE-OPERATING DEVICE OF OHC ENGINE AND COVER MEMBER FOR OHC ENGINE

(75) Inventors: Akira Furuya, Tokyo (JP); Takao Sakai, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/864,075

(22) Filed: May 22, 2001

(65) Prior Publication Data

US 2002/0007812 A1 Jan. 24, 2002

(30) Foreign Application Priority Data

May 23, 2000 (JP) ..... 2000-150852

(51) Int. Cl.[7] ..... F01M 9/06
(52) U.S. Cl. ..... 123/196 R
(58) Field of Search ..... 123/196 R, 90.33, 123/90.37, 196 M, 90.38; 184/11.1

(56) References Cited

U.S. PATENT DOCUMENTS 5,038,732 A * 8/1991 Matayoshi et al. ..... 123/193.5
5,058,542 A * 10/1991 Grayson et al. ..... 123/195 C
5,642,701 A * 7/1997 Oswald et al. ..... 123/193.5
5,709,185 A * 1/1998 Aizawa et al. ..... 123/196 R
5,992,355 A * 11/1999 Shichinohe et al. .... 123/195 C
6,138,633 A * 10/2000 Prior ..... 123/196 R

FOREIGN PATENT DOCUMENTS

JP 9151720 6/1997

* cited by examiner

*Primary Examiner*—Noah P. Kamen
*Assistant Examiner*—Jason Benton
(74) *Attorney, Agent, or Firm*—Martin A. Farber

(57) ABSTRACT

A ceiling surface of a rocker cover mounted on a top of a cylinder head has an oil guide groove and an oil dripping portion. The oil guide groove extends along a rotation direction of a chain and faces the chain for guiding lubricating oil droplets separated from the chain into a single flow in a certain direction. The oil dripping portion is continuous with the oil guide groove and protruding toward a valve-operating device for dripping the lubricating oil guided by the oil guide groove onto the valve-operating device. Oil droplets thrown off from the chain are collected by the oil guide groove and dripped onto the valve-operating device via the oil dripping portion. Therefore, it can effectively supply the oil to a position where the valve-operating cam slidably contacts with the slipper, thereby improving the frictional resistance of the valve-operating device.

3 Claims, 5 Drawing Sheets

STRUCTURE FOR LUBRICATING VALVE-OPERATING DEVICE OF OHC ENGINE AND COVER MEMBER FOR OHC ENGINE

BACKGROUND OF THE INVENTION

The present invention relates to a structure for lubricating a valve-operating device in an OHC engine.

In the prior art, OHV (overhead valve) and OHC (overhead camshaft) general-purpose engines have been widely used as power sources for mowers, power sprayers, power generators, etc. In an OHC engine, a valve-operating cam is provided on the cylinder head side, and is driven by a chain, a cogged belt, or the like, in synchronization with a crankshaft. A slipper of a rocker arm, which is provided to rock around a rocker shaft, slidably contacts with the valve-operating cam, so that the rocker arm is rocked by the rotation of the valve-operating cam so as to open/close an intake/exhaust valve.

In such a general-purpose engine, in order to lubricate a valve-operating system such as a chain, a sprocket, or a valve-operating cam, the chain or the cogged belt is used as an oil carrier so as to lubricate the valve-operating cam or the slipper. For example, Japanese Patent Laid-Open Publication No. Hei. 9-151720 proposes a system in which a wall portion is provided along an extended straight portion of a slack side of a timing belt, and oil droplets are thrown by a centrifugal force onto the wall portion, thereby making the oil droplets into minute droplets, so as to lubricate the various portions of the valve-operating system.

However, while such a lubricating system as disclosed in Japanese Patent Laid-Open Publication No. Hei. 9-151720 improves the lubrication by making the oil into minute droplets and diffusing them across the entire valve-operating device, the oil may not be sufficiently supplied onto the slidable contact surfaces between the valve-operating cam and the slipper. In other words, while there is an effect of uniformly lubricating the entire device, it had a problem that the oil is not effectively supplied to a specific portion which particularly requires good lubrication and which most requires oil supply.

SUMMARY OF THE INVENTION

An object of the present invention is to reliably supply a lubricating oil to slidable contact surfaces between the valve-operating cam and the slipper, which most requires oil supply.

In order to achieve the above mentioned object, there is provided a structure for lubricating a valve-operating device provided on a cylinder head side of an OHC engine, having a driving member for driving the valve-operating device in synchronization with a crankshaft and supplying a lubricating oil to the valve-operating device from an oil pan. The structure comprises an oil guide portion provided in a ceiling portion of a cover member mounted on a top of the cylinder head along a rotational direction of the driving member to face the driving member for guiding the flow of the lubricating oil separated from the driving member to a certain direction, and an oil dripping portion provided in the ceiling portion adjacent to the oil guide portion and protruding toward the valve-operating device for dripping the lubricating oil guided by the oil guide portion onto the valve-operating device.

According to the present invention, the lubricating oil, which has been separated from the driving member, can be collected by the oil guide portion, and supplied to the valve-operating device via the oil dripping portion. Therefore, it is possible to effectively supply the oil to a portion which particularly requires lubrication, thereby improving to decrease the frictional resistance of the valve-operating device and thus improving the product reliability.

The present invention also provides a cover member for covering a top of a cylinder head of an OHC engine and for accommodating a valve-operating device and a driving member for driving the valve-operating device in synchronization with a crankshaft. The cover member comprises an oil guide portion provided to face the driving member for guiding the flow of lubricating oil separated from the driving member to a certain direction, and an oil dripping portion provided adjacent to the oil guide portion and protruding toward the valve-operating device for dripping the lubricating oil guided by the oil guide portion onto the valve-operating device.

According to the cover member of the present invention, the lubricating oil, which has been separated from the driving member, can be collected by the oil guide portion, and supplied to the valve-operating device via the oil dripping portion. Therefore, it is possible to effectively supply the oil to a portion that particularly requires lubrication, thereby improving to decrease the frictional resistance of the valve-operating device and thus improving the product reliability.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Figure 1:
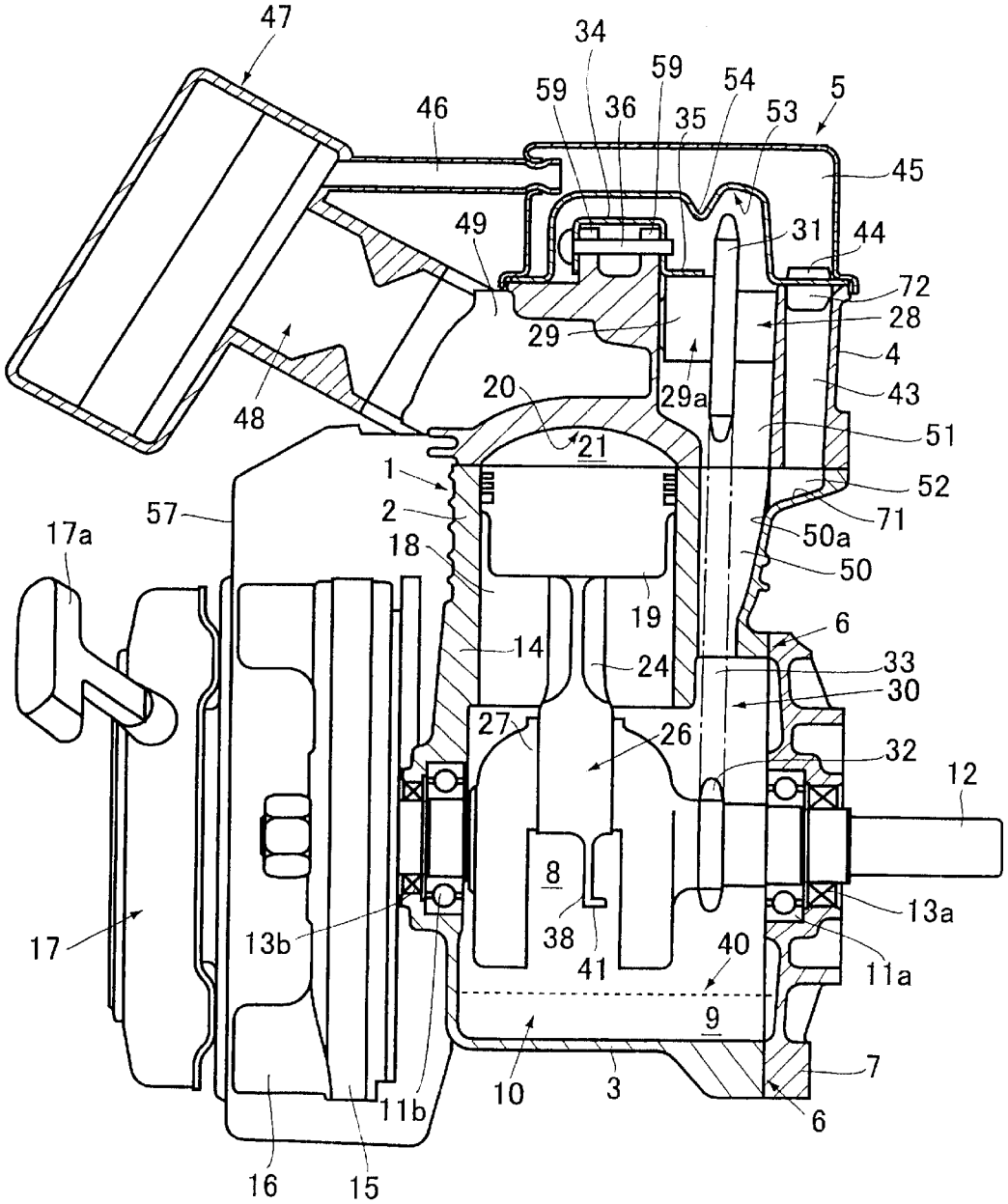
FIG. 1 is a diagram illustrating a structure of an OHC engine with a valve-operating device lubricating structure according to one embodiment of the present invention.
Figure 2:
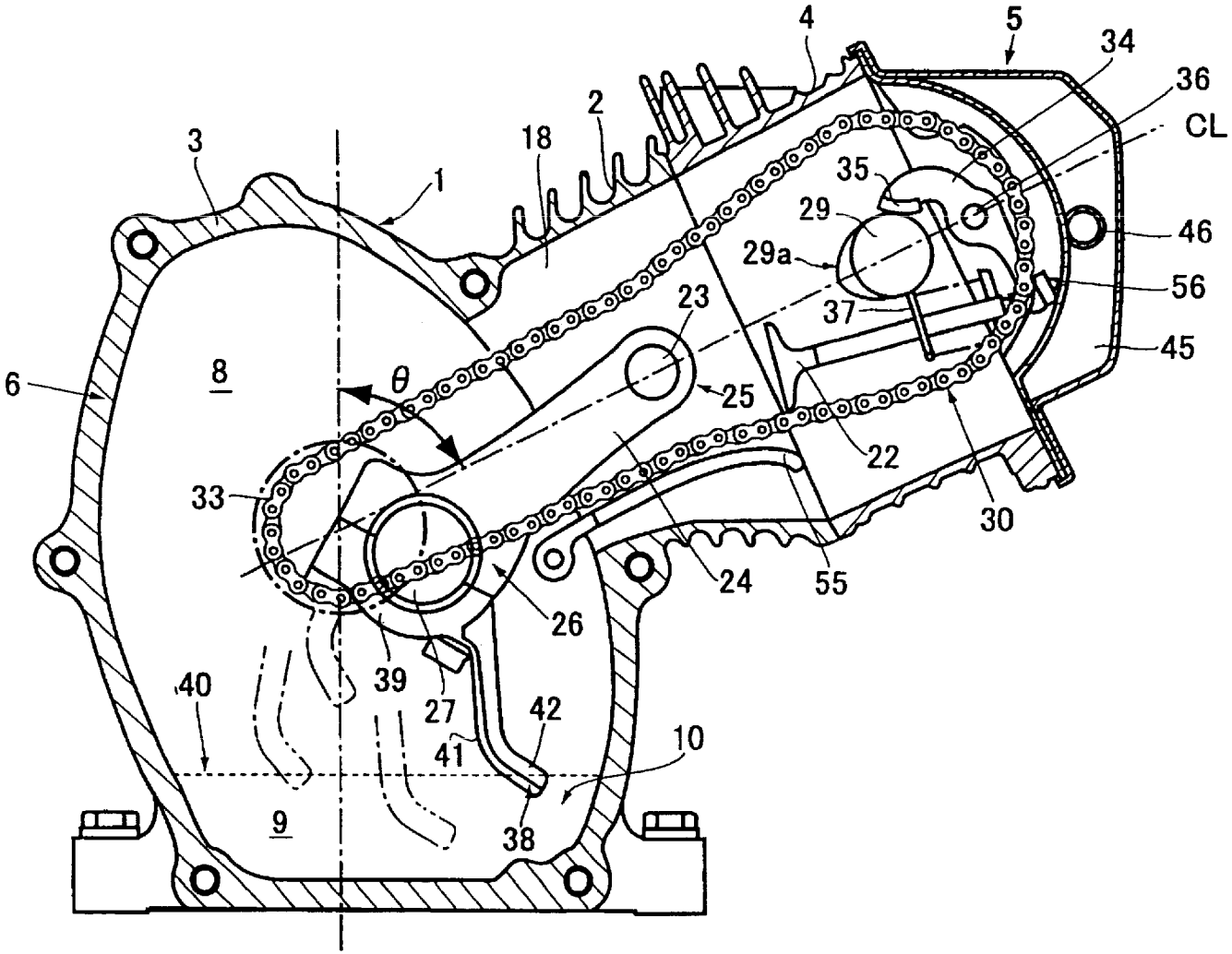
FIG. 2 is an explanatory cross-sectional view of a system of the engine of FIG. 1.

An embodiment of the present invention will now be described in detail with reference to the drawings. FIG. 1 is a diagram illustrating a structure of an OHC engine using a lubricating structure of a valve-operating device in one embodiment of the present invention. FIG. 2 is an explanatory cross-sectional view of the engine of FIG. 1 taken along a cylinder axis direction.

The engine of FIG. 1 is a single-cylinder 4-cycle gasoline engine, and is a so-called "inclined OHC engine" in which the cylinder axis CL is inclined by an angle θ with respect to the gravitational direction (see FIG. 2). In the engine, an engine body 1 includes a cylinder block 2 and a crank case 3 which are integrally formed with each other. The engine body 1 is made of iron or a light metal alloy such as an aluminum alloy. A cylinder head 4 made of an aluminum alloy is attached to an upper portion of the cylinder block 2. A rocker cover (cover member) 5 integrally made of a pair of pieces of sheet metal or a synthetic resin is mounted on a top of the cylinder head 4.

The crank case 3 has a large opening on the right side thereof in FIG. 1, thereby providing a main bearing case attachment surface 6. A main bearing case 7 made of an aluminum alloy is attached to the main bearing case attachment surface 6. Thus, a crank chamber 8 is provided in the crank case 3, and an oil pan 10 is provided under the crank chamber 8 for storing a lubricating oil (hereinafter referred to simply as "oil") 9.

A main bearing lla is press-fitted into the main bearing case 7, and one end of a crankshaft 12 is supported by the main bearing 11*a*. An oil seal 13*a* is press-fitted on the outer side of the main bearing 11*a*.

A main bearing 11*b* is press-fitted into a wall surface 14 of the crank case 3 opposite to the main bearing case attachment surface 6. The other end side of the crankshaft 12 is supported by the main bearing 11*b*. Similarly, an oil seal 13*b* is provided on the outer side of the main bearing 11*b*. The oil seals 13*a* and 13*b* prevent the oil 9 stored in the oil pan 10 from leaking out of the crank case 3 along the crankshaft 12.

A flywheel 15 and a cooling fan 16 are attached to an end portion of the crankshaft 12 that extends out of the crank case 3 through the wall surface 14. The cooling fan 16 is provided outside the crank case 3 and within a casing 57, and rotates together with the crankshaft 12 so as to induce a cooling air from an outside of the casing 57. The engine body 1, the cylinder head 4, etc., are cooled by the induced cooling air. Moreover, a recoil device 17 is provided on the outer side of the casing 57. By pulling a recoil lever 17*a* by hand, the crankshaft 12 is rotated to start the engine.

A cylinder bore 18 is provided in the cylinder block 2. A piston 19 is fitted within the cylinder bore 18 so as to slidably reciprocate therein. An upper end of the cylinder bore 18 is closed by the cylinder head 4, and an upper surface of the piston 19 and a bottom wall surface 20 of the cylinder head 4 together form a combustion chamber 21. An intake valve 22, an exhaust valve (not shown), an ignition plug (not shown), etc., are provided facing the upper portion of the combustion chamber 21.

A small end portion 25 of a connecting rod 24 is rotatably connected to the piston 19 via a piston pin 23. A crank pin 27 of the crankshaft 12 is rotatably connected to a large end portion 26 of the connecting rod 24. Thus, the crankshaft 12 is rotated along with the vertical reciprocation of the piston 19.

A camshaft 28 is provided in the cylinder head 4 which is in parallel with the crankshaft 12 on the cylinder axis CL. The camshaft 28 includes a valve-operating cam 29 and a sprocket 31, which are integrally formed with each other. The valve-operating cam 29 is driven in synchronization with the crankshaft 12 by a timing system 30.

A sprocket 32 is secured on the crankshaft 12. Chain chambers 50 and 51 are provided in the cylinder block 2 and the cylinder head 4, respectively, and the sprocket 31 and the sprocket 32 are connected to each other via a chain (driving member) 33 provided in the chain chambers 50 and 51. The sprockets 31,32 and the chain 33 together form the timing system 30. The number of teeth of the sprocket 31 is twice as large as the number of teeth of the sprocket 32, so that the valve-operating cam 29 undergoes one revolution per two revolutions of the crankshaft 12. The chain 33 is provided with an appropriate tension by a chain tensioner 55.

The valve-operating cam 29 is provided with a cam surface 29*a*, and a slipper 35 formed at one end of a rocker arm 34 slidably contacts with the cam surface 29*a*. The valve-operating cam 29 and the rocker arm 34 together form a valve-operating device. Two rocking type of rocker arms 34 are provided respectively for intaking and exhausting air. Each of the rocker arms 34 is provided to rock around a rocker shaft 36 which is supported by a rocker support 59. The other end of each rocker arm 34 is connected to a top portion of the intake valve 22 or an exhaust valve (not shown) via an adjust screw 56. The intake valve 22 and the exhaust valve are each driven as the rocker arm 34 is rocked by the valve-operating cam 29. The intake valve 22 and the exhaust valve are each biased by a valve spring 37 toward the closed position. Thus, the intake valve 22, etc., are opened/closed along with the rotation of the valve-operating cam 29.

The timing system 30 is lubricated by a scraper 38 provided on a large end portion 26 of the connecting rod 24. As illustrated in FIG. 2, the scraper 38 extends downward from a lower member 39 of the large end portion 26, i.e., in a radial direction of the crankshaft 12. The scraper 38 rocks along with the rotation of the crankshaft 12 through a path as indicated by a one-dotted-chain line in FIG. 2. Thus, the oil 9 stored in the oil pan 10 is picked up by the scraper 38, and the oil 9 is splashed onto the chain 33 when the scraper 38 comes out of an oil surface 40, thereby lubricating the timing system 30.

The scraper 38, having a generally L-shaped cross section, includes a bottom wall 41 and a side wall 42 extending integrally with the bottom wall 41 along one side of the bottom wall 41. In the present embodiment, the angle $\alpha$ formed between the bottom wall 41 and the side wall 42 is set to be 90°. However, the angle therebetween is not limited to the right angle, but may be appropriately selected in the range of about 60° to about 90°.

Along with the rocking of the scraper 38, the oil 9 is scraped up by the bottom wall 41, and the oil 9 scraped up by the bottom wall 41 is guided to the side wall 42 and splashed away from the side wall 42. Thus, the droplets of the oil 9 are splashed also in three-dimensionally inclined directions, i.e., in the lateral direction from the scraper 38, thereby throwing some droplets of the oil 9 toward the root end portion of the chain tensioner 55. Some of the droplets hit the inner wall of the crank case 3 and are bounced back toward the chain 33. In this way, droplets of the oil 9 can be supplied to the chain 33, which is offset toward the main bearing case 7 with respect to the scraper 38, thereby ensuring the supply of the oil 9 to the chain 33.

The oil 9 thus splashed onto the chain 33 is transferred toward the cylinder head 4 along with the movement of the chain 33, thereby lubricating the sprocket 31 also. Moreover, the sprocket 32 is also lubricated by the oil 9 attached on the chain 33.

On the side of the cylinder head 4, some of the oil 9 attached on the chain 33 is shaken off by a centrifugal force. Specifically, as a portion of the chain 33 travels around the sprocket 31, some of the oil 9 on that portion of the chain 33 is thrown off the chain 33 in the circumferential direction of the sprocket 31. In the illustrated engine, the rocker cover 5 is provided above the sprocket 31, and those droplets of the oil 9 hit the ceiling surface (ceiling portion) 53 of the rocker cover 5. The oil 9 attached onto the ceiling surface 53 runs down along the ceiling surface 53 back into the oil pan 10 via the chain chambers 51 and 50.

Figure 3:
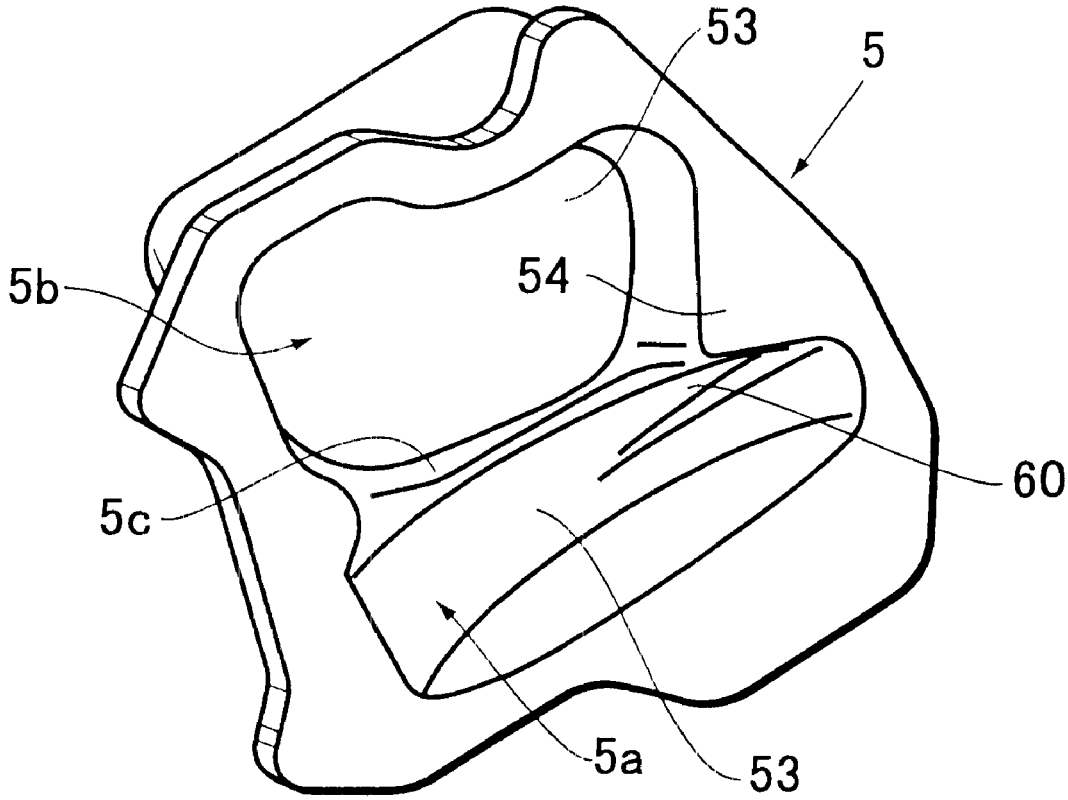
FIG. 3 is a perspective view illustrating a rocker cover as viewed from the bottom side.
Figure 4:
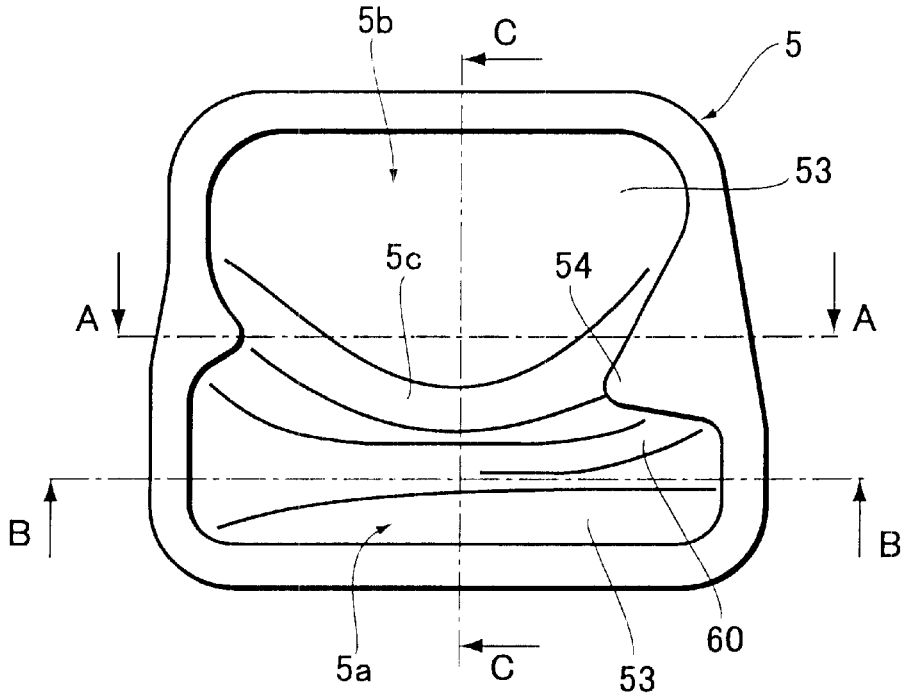
FIG. 4 is a bottom view of the rocker cover.
Figure 5:
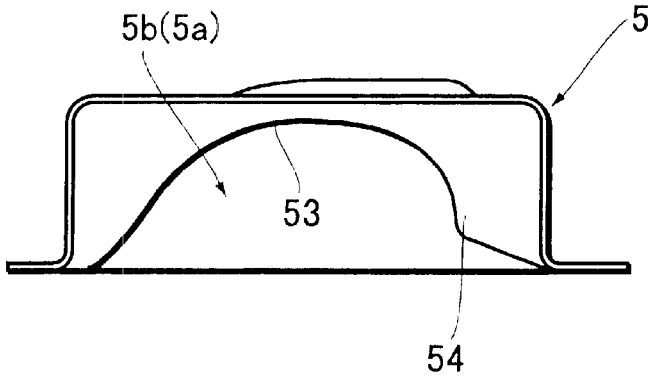
FIG. 5 is a cross-sectional view taken along line A—A of FIG. 4.
Figure 6:
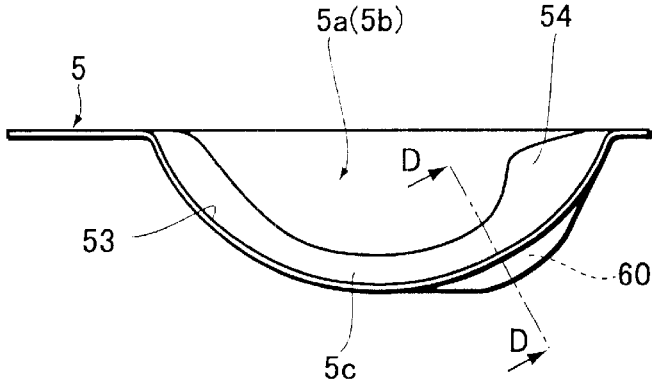
FIG. 6 is a cross-sectional view taken along line B—B of FIG. 4.
Figure 7:
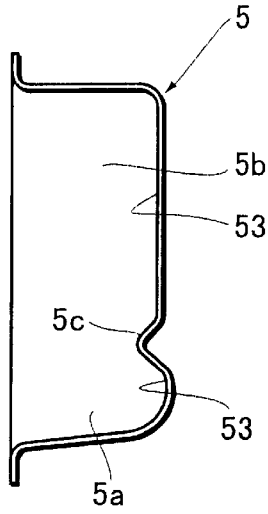
FIG. 7 is a cross-sectional view taken along line C—C of FIG. 4.
Figure 8:
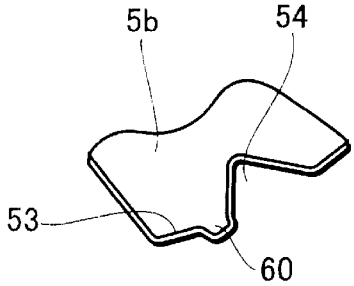
FIG. 8 is a cross-sectional view taken along line D—D of FIG. 6.

In the present invention, an oil guide groove (oil guide portion) 60 and an oil dripping portion 54 are provided on the ceiling surface 53 of the rocker cover 5, so that the oil 9 attached onto the ceiling surface 53 drips from the oil dripping portion 54. FIG. 3 is a perspective view illustrating the rocker cover 5 as viewed from the bottom side, FIG. 4 is a bottom view thereof, FIG. 5 is a cross-sectional view taken along line A—A of FIG. 4, FIG. 6 is the cross-sectional view taken along line B—B of FIG. 4, FIG. 7 is the cross-sectional view taken along line C—C of FIG. 4, and FIG. 8 is the cross-sectional view taken along line D—D of FIG. 6. The rocker cover 5 is attached to the upper portion of the cylinder head 4 so that the left side portion thereof in FIG. 4 is positioned on the opposite side of the engine in FIG. 1 along the direction perpendicular to the paper of FIG. 1.

The rocker cover 5 is generally divided into a sprocket chamber 5*a* for accommodating the sprocket 31 therein and a rocker arm chamber 5*b* for accommodating the rocker arm 34. The sprocket chamber 5*a* is communicated to the chain chamber 51 of the cylinder head 4, and a ridge portion 5*c* is formed between the chambers 5*a* and 5*b* , as illustrated in FIG. 7.

The ceiling surface 53 of the sprocket chamber 5*a* is provided with the oil guide groove 60 which runs deeper than the ceiling surface 53. The oil guide groove 60 is positioned at the side of rocker arm chamber 5*b* side of the sprocket chamber 5*a* and extends from the center (line C—C) of the sprocket chamber 5*a* toward the right side of FIG. 4 along the ridge portion 5*c*. Thus, the oil guide groove 60 is provided above the chain 33 in a position facing the chain 33. In FIG. 6, the portion protruding in the lower right direction represents the profile of the oil guide groove 60, and FIG. 8 illustrates the oil guide groove 60 being formed to be deeper than the ceiling surface 53.

In the vicinity of the end portion(on the right side of FIG. 4) of the oil guide groove 60, the oil dripping portion 54 having a triangular (pyramidal) shape is protruding from the ridge portion 5*c,* and the foot portion thereof is continuous with the oil guide groove 60. FIGS. 5 and 6 illustrate the oil dripping portion 54 protruding from the ridge portion 5*c*. FIG. 8 illustrates the oil dripping portion 54 being continuous with the oil guide groove 60.

Moreover, the engine is so designed that when the rocker cover 5 is attached to the cylinder head 4, the oil dripping portion 54 is located at a position above the valve-operating cam 29, more particularly a position corresponding to a position where the valve-operating cam 29 slidably contacts with the slipper 35. Thus, as illustrated in FIG. 1, the structure is such that the valve-operating cam 29 is positioned directly under the oil dripping portion 54 so that the oil 9 dripping from the oil dripping portion 54 hits the inner side surface of the slipper 35.

In the sprocket chamber 5*a* having such a structure, the chain 33 is arranged generally along line B—B of FIG. 4, and runs in a left to right direction in FIG. 4. When the engine is started, the oil 9 is supplied to the chain 33 by the scraper 38, as described above, and the oil 9 is thrown off from the chain 33 by a centrifugal force in the circumferential direction in the sprocket chamber 5*a*. Thus, the oil 9 is thrown and attached onto the ceiling surface 53 of the sprocket chamber 5*a*.

The oil 9 that has been attached onto the proximal side of the ceiling surface 53 (the left side of line C—C in FIG. 4) runs down along the inner surface of the rocker cover 5 back into the oil pan 10 via the wall surface of the chain chambers 51 and 50. Some of the oil 9 that has been attached onto the far side of the ceiling surface 53 (the right side of line C—C in FIG. 4) is induced into the oil guide groove 60. The oil 9 which has run into the oil guide groove 60 runs along the oil guide groove 60 and then along the side wall of the oil dripping portion 54 to reach a top end portion of the oil dripping portion 54, from which the oil 9 drips down due to gravity.

In the present invention, the valve-operating cam 29 is arranged below the oil dripping portion 54, whereby the oil 9 dripping from the oil dripping portion 54 hits the valve-operating cam 29 and the slipper 35. In this way, the oil 9 thrown off from the chain 33 is collected by the oil guide groove 60 and then supplied to the valve-operating cam 29 via the oil dripping portion 54. Therefore, by using the rocker cover 5 of the present invention, it is possible to reliably supply the oil to the slidable contact surface between the valve-operating cam 29 and the slipper 35. Thus, as compared to a case where the lubrication is provided by diffused oil droplets, it is possible to more effectively supply the oil to the portion which particularly requires lubrication without increasing the number of parts.

The oil dripping position is such that the oil drips toward the shaft center of the valve-operating cam 29 in a normal setting so that the oil drips onto the valve-operating cam 29 as much as possible even when the engine is inclined. Alternatively, the dripping position may be the slipper 35, or a position between the slipper 35 and the valve-operating cam 29.

In the cylinder head 4, a gas-liquid separation chamber 43 is provided separately from the chain chamber 51. Another gas-liquid separation chamber 45 is provided in the rocker cover 5 and is communicated to the gas-liquid separation chamber 43 via a lead valve 44. The gas-liquid separation chamber 45 is connected to an air cleaner 47 via a blow-by passageway 46. The air cleaner 47 is connected to an intake port 49 in the cylinder head 4 via a carburetor 48.

The gas-liquid separation chambers 43,45 are provided for separating a mist of the oil 9 from a blow-by gas as the blow-by gas stored in the crank chamber 8 is recirculated to the air cleaner 47. In the illustrated engine, the gas-liquid separation chamber 43 is opened to the chain chamber 50, which is provided separately from the cylinder bore 18. Thus, a gas inlet 52 is provided at the upper end portion of the chain chamber 50 of the cylinder block 2, and the blow-by gas, which has flowed into the chain chamber 50, flows into the gas-liquid separation chamber 43 via the gas inlet 52. As the blow-by gas flows through the gas-liquid separation chamber 43, the oil mist contained therein attaches to the wall surface of the gas-liquid separation chamber 43, thereby separating the oil mist from the blow-by gas. The oil component, which has been separated in the gas-liquid separation chamber 43, returns to the oil pan 10 via the wall surfaces of the gas-liquid separation chamber 43 and then the chain chamber 50.

The blow-by gas, which has flowed into the rocker cover 5 via the lead valve 44, is subjected to a further oil mist separation process in the gas-liquid separation chamber 45. Specifically, the oil mist contained in the blow-by gas, which has entered the gas-liquid separation chamber 45, attaches to the wall surface of the gas-liquid separation chamber 45, thereby achieving a further gas-liquid separation. Incidentally, an oil return hole (not shown) may be provided in the bottom surface of the rocker cover 5, whereby the oil, which has attached to the wall surface of the gas-liquid separation chamber 45, flows into the chain chambers 51 and 50 through the oil return hole and returns to the oil pan 10 via the wall surface of the chain chambers 51 and 50.

The present invention has been specifically described above based on a particular embodiment thereof. It is understood, however, that the present invention is not limited to the above-described embodiment, but rather various modifications can be made thereto without departing from the scope and spirit of the present invention.

For example, in the embodiment described above, the ceiling surface 53 of the rocker cover 5 is provided with the oil guide groove 60 as an oil guide portion in order to improve the lubrication efficiency without increasing the number of parts. Alternatively, a separate oil guide plate may be additionally used for the same purpose.

While the present invention is applied to an inclined type of engine in the embodiment described above, it is of course possible to apply the present invention to a normal type engine in which the center line of the cylinder is arranged in the gravitational direction. Moreover, while the present invention is applied to an air-cooled engine with a single-cylinder, the present invention may alternatively be applied to an air-cooled engine with a multi-cylinder, or a liquid-cooled engine with a single- or multi-cylinder.

While the cylinder block 2 and the crank case 3 are formed integrally with each other in the embodiment described above, they may alternatively be provided separately, and the cylinder head 4 and the cylinder block 2 may be formed integrally with each other. In addition, while the timing system 30 is provided by using the sprockets 31, 32 and the chain 33 in the embodiment described above, the timing system 30 may alternatively be provided by using other driving members known in the art, such as a cogged pulley and a cogged belt, or a timing pulley and a timing belt. Moreover, in the present invention, the term "rotation" has a general concept including a circular motion in both directions, i.e., a clockwise direction and a counterclockwise direction, not a circular motion in only one direction.

According to the structure for lubricating the valve-operating device in the OHC engine of the present invention, the ceiling surface of the rocker cover to be mounted on a top of the cylinder head is provided with the oil guide portion for guiding the oil droplets, which have been thrown off from the chain, into a single flow in a certain direction, and an oil dripping portion for dripping the oil 9, which is guided by the oil guide portion, onto the valve-operating device. Thus, it is possible to efficiently collect the oil droplets, which have been thrown off from the chain, and to supply the oil from the oil dripping portion onto a valve-operating cam. In this way, it is possible to reliably supply the oil to a slidable contact surface between the valve-operating cam and a slipper, which particularly requires lubrication, thereby realizing more effective lubrication than that provided by diffused oil droplets. Thus, it is possible to suppress the friction of the valve-operating cam or the slipper,. thereby improving the product reliability.

While there have been described what are at present considered to be preferred embodiments of the present invention, it will be understood that various modifications may be made thereto, and it is intended that the appended claims cover all such modifications as fall within the true spirit and scope of the invention.

What is claimed is:

1. A structure for lubricating a valve-operating device provided on a cylinder head side of an OHC engine, having a driving member for driving the valve-operating device in synchronization with a crankshaft and supplying a lubricating oil to the valve-operating device from an oil pan, comprising:

an oil guide portion provided in a ceiling portion of a cover member mounted on a top of the cylinder head along a rotational direction of the driving member to face the driving member for guiding the flow of the lubricating oil separated from the driving member to a certain direction; and an oil dripping portion provided in the ceiling portion adjacent to the oil guide portion and protruding toward the valve-operating device for dripping the lubricating oil guided by the oil guide portion onto the valve-operating device.

2. A cover member for covering a top of a cylinder head of an OHC engine and for accommodating a valve-operating device and a driving member for driving the valve-operating device in synchronization with a crankshaft, comprising:

an oil guide portion provided to face the driving member for guiding the flow of lubricating oil separated from the driving member to a certain direction; and an oil dripping portion provided adjacent to the oil guide portion and protruding toward the valve-operating device for dripping the lubricating oil guided by the oil guide portion onto the valve-operating device.

3. A structure for lubricating a valve-operating device provided on a cylinder head side of an OHC engine having a driving member formed by a sprocket arid a rocker arm for driving the valve-operating device in synchronization with a crankshaft arid supplying a lubricating oil to the valve-operating device from an oil pan, and a cover member mounted on a top of the cylinder head, comprising:

a ridge portion for dividing the cover member into a sprocket chamber accommodating the sprocket and a rocker arm chamber accommodating the rocker arm, an oil guide portion provided in a ceiling portion of said cover member along a rotational direction of the driving member to face the driving member for guiding a flow of lubricating oil separated from the driving member to a certain direction; and an oil dripping portion provided in the ceiling portion adjacent to the oil guide portion and protruding toward the valve-operating device for dripping the lubricating oil guided by the oil guide portion onto the valve-operating device.

* * * * *